United States Patent [19]

Quelch

[11] 4,372,598

[45] Feb. 8, 1983

[54] CONTOUR BOTTLE CARRIER

[76] Inventor: Albert G. B. Quelch, 5841 Melshire Dr., Dallas, Tex. 75230

[21] Appl. No.: 226,452

[22] Filed: Jan. 19, 1981

Related U.S. Application Data

[63] Continuation-in-part of Ser. No. 177,244, Aug. 11, 1980.

[51] Int. Cl.[3] ..... B65D 71/00

[52] U.S. Cl. ..... 294/87.2; 206/145; 206/199; 206/427

[58] Field of Search ..... 294/1 R, 27 R, 31.2, 294/33, 63 A, 86 R, 87.2-87.28, 90, 99 R, 148, 159, DIG. 2; 206/139, 145, 147, 148, 150, 151, 159, 161, 162, 199, 201, 427, 430, 433; 215/100 A; D9/344

[56] References Cited

U.S. PATENT DOCUMENTS

| | | | |
|---|---|---|---|
| 1,541,672 | 6/1925 | Tulay | 206/199 |
| 1,781,056 | 11/1930 | Elder | 206/139 X |
| 2,693,385 | 11/1954 | Cavalli et al. | 294/87.2 |
| 2,803,487 | 8/1957 | Dalton | 294/87.28 |
| 2,936,070 | 5/1960 | Poupitch | 294/87.2 X |
| 2,996,329 | 8/1961 | Glazer | 294/87.2 |
| 3,003,805 | 10/1961 | Glazer | 294/87.2 |
| 3,036,853 | 5/1962 | Glazer | 294/87.2 |
| 3,086,805 | 4/1963 | Dardaine et al. | 294/87.2 X |
| 3,178,217 | 4/1965 | Bargel | 294/86 R |
| 3,250,564 | 5/1966 | Stern et al. | 294/87.2 |
| 3,339,814 | 9/1967 | Carbine | 224/45 |
| 3,443,685 | 5/1969 | Wanderer | 294/87.2 X |
| 3,446,346 | 5/1969 | Burge | 206/65 |
| 3,527,345 | 9/1970 | Iorio | 206/65 |
| 3,633,962 | 1/1972 | Erickson | 294/87.2 |
| 3,751,098 | 8/1973 | Owen | 294/87.2 |
| 3,856,343 | 12/1974 | Muller | 294/90 X |
| 3,871,699 | 3/1975 | Hatfield | 294/87.2 |
| 3,907,105 | 9/1975 | Nowak | 206/216 |
| 3,951,259 | 4/1976 | Oglesbee | 206/164 |
| 3,968,914 | 7/1976 | Goncalves | 224/45 AA |
| 4,022,363 | 5/1977 | Eliassen | 224/45 AA |
| 4,063,771 | 12/1977 | Calvert | 294/87.2 |
| 4,090,729 | 5/1978 | Erickson | 294/31.2 |
| 4,093,295 | 6/1978 | Erickson | 294/87.2 |
| 4,095,720 | 6/1978 | Delbrouck et al. | 220/21 |
| 4,136,772 | 1/1979 | Mascia et al. | 206/199 |
| 4,159,841 | 7/1979 | Calvert | 294/87.2 |
| 4,192,540 | 3/1980 | Oliff | 294/87.2 |
| 4,235,468 | 11/1980 | Erickson | 294/87.2 |

FOREIGN PATENT DOCUMENTS

| | | | |
|---|---|---|---|
| 2068858 | 8/1971 | France | 294/87.2 |

*Primary Examiner*—Johnny D. Cherry

*Attorney, Agent, or Firm*—Hubbard, Thurman, Turner & Tucker

[57] ABSTRACT

A carrier (10) for supporting a plurality of bottles by their necks includes a frame (12) having a plurality of openings (18) defined by interconnected hollow cylindrical sections (20, 22) for releasably receiving and retaining the bottles. Each opening (18) includes two portions of different widths, with the wide portion being bounded by the smaller cylindrical segments (20) and the narrow portion being bounded by the larger cylindrical sections. Other embodiments (32, 46) utilizing other arrangements of deformable hollow sections (42, 62 and 72) to define the bottle receiving opening are also disclosed.

5 Claims, 12 Drawing Figures

CONTOUR BOTTLE CARRIER

CROSS REFERENCE TO RELATED APPLICATION

This is a continuation-in-part of copending application Ser. No. 177,244, filed Aug. 11, 1980.

TECHNICAL FIELD

The present invention relates generally to containers, and more particularly to an improved bottle carrier for releasably supporting a plurality of bottles by their necks.

BACKGROUND ART

In the beverage industry, individual containers of products are typically packaged in groups of six or eight for distribution to the consumer. Returnable bottles, for example, are usually packaged in cartons by which the bottles can be returned later after use. Disposable or non-returnable containers, such as bottles and cans are packaged in carriers which are intended to be used but once, and must therefore be as inexpensive as possible. Since bottles are easily broken, it will be appreciated that bottle carriers must be not only inexpensive but also capable of securely supporting the bottles in such a way that the bottles are readily available for disconnection and consumption.

Such bottle carriers have been available heretofore, but the bottle carriers of the prior art have not been entirely satisfactory in at least two respects. In general, the prior bottle carriers are too expensive for one-time usage, and have not been reliably capable of securely supporting the bottles in the desired relationship. Examples of the bottle carriers of the prior art are shown in U.S. Pat. No. 3,633,962 to Erickson, U.S. Pat. Nos. 3,036,853 and 2,996,329 to Glazer, and U.S. Pat. No. 2,803,487 to Dalton, all of which utilize either U-shaped retainer clips or split collars to receive the bottle necks.

A need thus exists for a new and improved carrier for releasably retaining a plurality of bottles.

SUMMARY OF INVENTION

The present invention comprises a bottle carrier which overcomes the foregoing and other difficulties associated with the prior art. In accordance with the invention, there is provided a novel bottle carrier which is less expensive to fabricate and which provides better structural support for the bottles therein.

The first bottle carrier embodiment herein comprises a frame with a plurality of bottle neck receivers and a pair of finger openings formed therein. Each bottle neck receiver is comprised of a plurality of interconnected hollow cylindrical segments arranged to define a keyhole shaped opening for receiving and retaining a bottle by its neck. The bottle neck receiving openings are preferably arranged in opposing pairs with the corner openings being oriented diagonally to facilitate disconnection of the bottles therefrom. In the preferred embodiment, a skirt extends downwardly from the frame to stabilize the bottles in the carrier.

A second embodiment is particularly adapted for carrying a pair of bottles, while a third embodiment is adapted to facilitate stacking of bottles in similar carriers or in cases. In each embodiment, the bottle neck receiving openings are defined by various arrangements of hollow or cylindrical segments.

BRIEF DESCRIPTION OF DRAWINGS

A more complete understanding of the invention can be had by reference to the following Detailed Description in conjunction with the accompanying Drawings, wherein.

DETAILED DESCRIPTION

Figure 1:
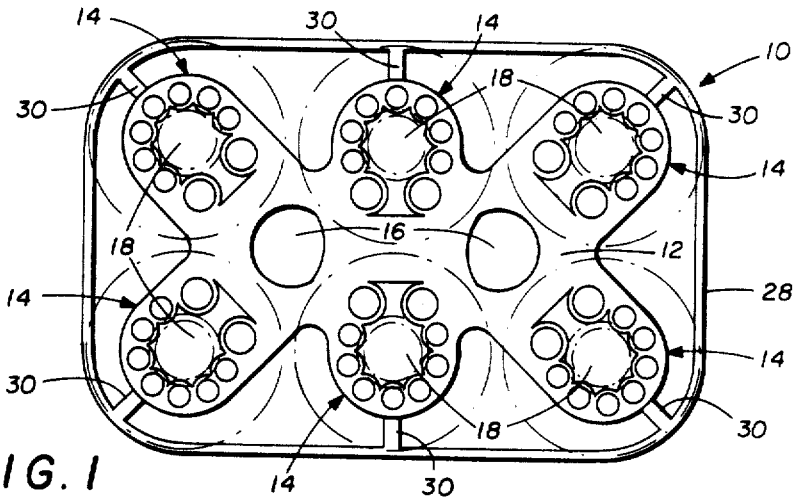
FIG. 1 is a top view of a bottle carrier incorporating a first embodiment of the invention.

Referring now to the Drawings, wherein like reference numerals designate corresponding elements throughout the views, and particularly referring to FIG. 1, there is shown a bottle carrier 10 representing the first embodiment of the invention. Bottle carrier 10 is adapted to carry a plurality of bottles, which are shown in phantom lines, in releasable interlocked engagement, and is also adapted for manufacture by means of conventional injection molding techniques utilizing plastic such as high density polyethylene or other suitable materials. Although carrier 10 is shown in the six-pack embodiment, it will be appreciated that the invention can be configured to carry any number of bottles.

Bottle carrier 10 comprises a generally flat frame 12 having a plurality of bottle receivers 14 integrally formed therein in spaced apart relationship. A pair of optional finger openings 16 are provided in frame 12 to facilitate handling of carrier 10. The bottle receivers 14 are arranged in opposing pairs, and the corner receivers are preferably oriented diagonally to facilitate disconnection of the bottles from the carrier. As will be explained more fully hereinafter, each bottle receiver 14 defines a generally keyhole-shaped opening 18 for releasably receiving and retaining a bottle.

Figure 3:
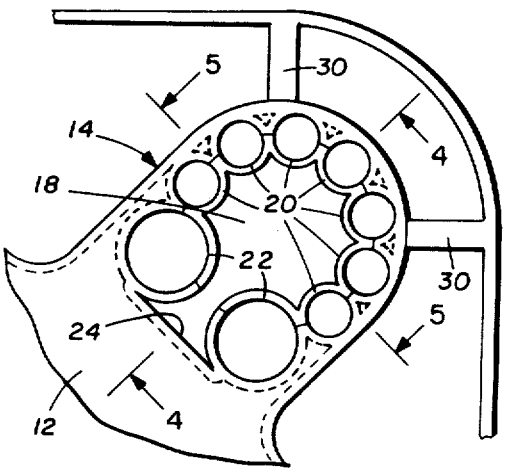
FIG. 3 is an enlarged view of a portion of the bottle carrier showing further details of a typical bottle neck receiver therein.
Figure 4:
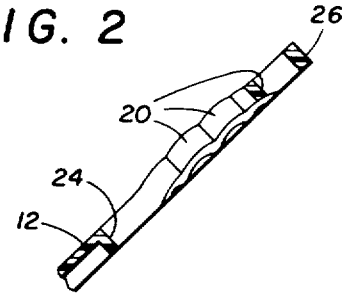
FIGS. 4 and 5 are sectional views taken along lines 4 and 5, respectively, of FIG. 3 in the direction of the arrows.
Figure 5:
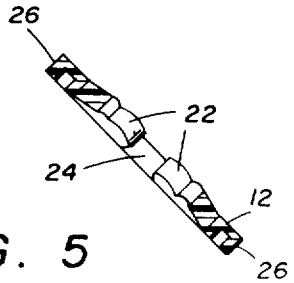

The constructional details of a typical bottle receiver 14 in carrier 10 are shown in FIGS. 3–5. The opening 18 of each receiver 14 is defined by a plurality of interconnected hollow cylindrical segments 20 and 22. The relatively smaller cylindrical segments 20 define the major or wide portion of opening 18, while the relatively larger cylindrical segments 22 define the minor or narrow portion of the opening. In the preferred embodiment, as is best shown in FIGS. 4 and 5, the top and bottom inner portions of the cylindrical segments 20 and 22 bordering opening 18 are angled upwardly to facilitate insertion of a bottle and to resist disconnection after insertion. Cylindrical segments 22 are interconnected by a flange or rib 24 to close the narrow portion of opening 18. If desired, a flange 26 can be provided around the entire periphery of frame 12 to lend additional rigidity to carrier 10.

The structure defining each opening 18 comprises a significant feature of the invention. Due to their relative sizes, cylindrical segments 20 are more rigid than cylindrical segments 22. The larger cylindrical segments 22 yield to allow insertion of a bottle, and then resiliently urge the bottle against the smaller cylindrical segments 20 which also deform slightly to accommodate the bottle. The neck of the bottle is thus engaged securely between the resilient cylindrical segments 20 and 22. To effect removal, the lower portion of a bottle is pulled outwardly thereby deforming cylindrical segments 20 and 22 so that the bottle can be disconnected from carrier 10.

While the hollow cylindrical segments 20 and 22 are shown with similar wall thicknesses, it will be understood that their wall thicknesses are dependent upon the stiffness desired. For example, the wall thickness of the larger cylindrical segments 22 can be somewhat thicker to stiffen the minor or narrow ends of openings 18 and secure the bottles more tightly in place.

Figure 2:
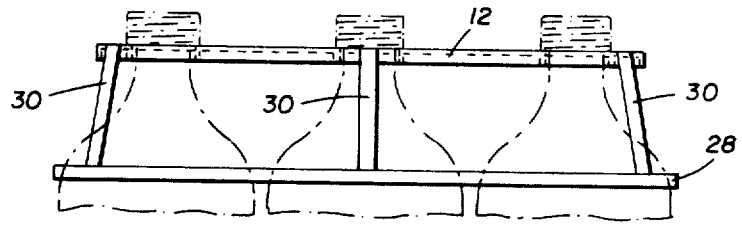
FIG. 2 is an elevational view of the bottle carrier shown in FIG. 1, with the bottles therein shown in phantom lines.

Referring again to FIGS. 1 and 2, bottle carrier 10 further includes an optional skirt 28 connected to frame 12 by a plurality of fingers 30 for stabilizing the bottles therein. The generally rectangular skirt 28 is adapted to surroundingly engage the bodies of the bottles, and may be desirable in some instances; however, it will be understood that the use of skirt 28 with bottle carrier 10 is optional.

Figure 6:
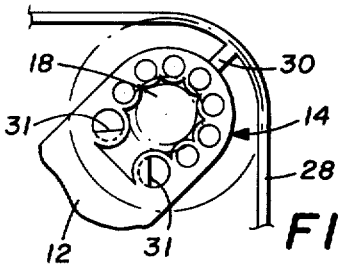
FIG. 6 is a partial reduced top view illustrating an optional modification to the first embodiment.

FIG. 6 illustrates a modification of bottle carrier 10 wherein partial webs or tabs 31 can be provided over cylindrical segments 22 of receivers 14 primarily to facilitate mechanical pickup of carriers from a stack thereof for application to the bottles. Segments 22 are otherwise hollow except for the tabs 31 partially closing their upper ends. Tabs 31 also serve to reinforce and stiffen segments 22.

Figure 7:
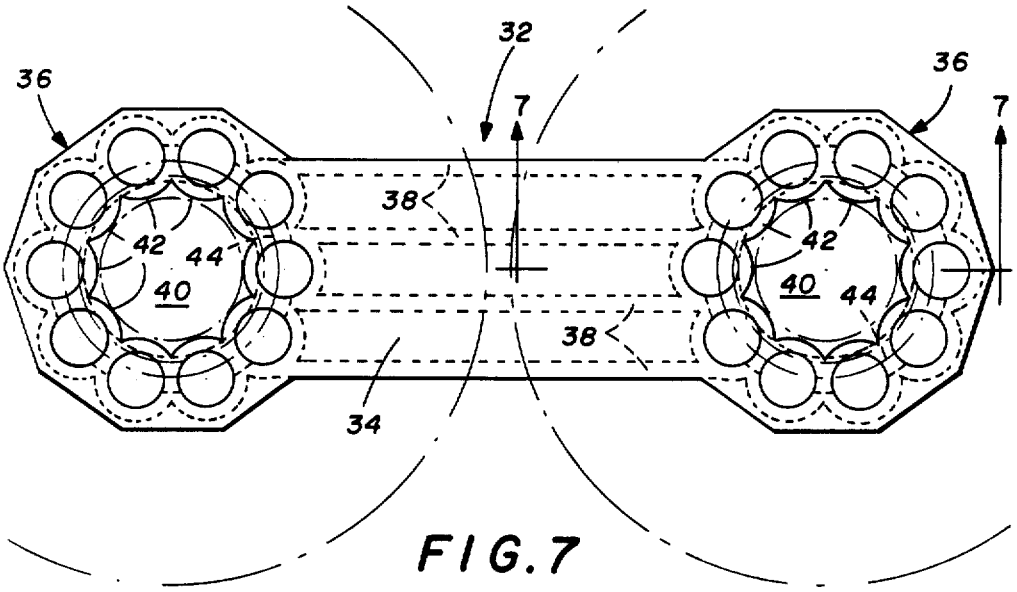
FIG. 7 is a top view of a bottle carrier incorporating a second embodiment of the invention.
Figure 8:
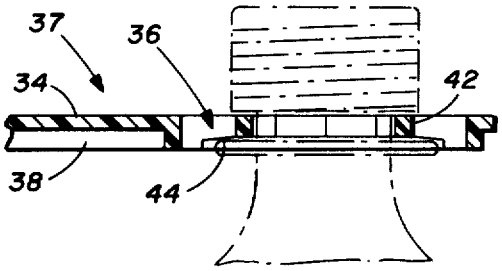
FIG. 8 is an enlarged sectional view taken along lines 8—8 of FIG. 7 in the direction of the arrows, with a bottle therein shown in phantom lines.

Turning now to FIGS. 7 and 8, there is shown a bottle carrier 32 representing the second embodiment of the invention. Bottle carrier 32 is particularly adapted to carry a pair of bottles, such as the one quart or two liter size bottles, in releasable interlocked engagement to facilitate handling. The bottles have been shown in phantom lines in FIGS. 7 and 8. Like bottle carrier 10 described above, the bottle carrier 32 is also adapted for manufacture by means of conventional injection molding techniques with plastic or other appropriate material.

Bottle carrier 32 comprises an elongate, generally flat frame 34 with bottle receivers 36 integrally formed therein at opposite ends of the frame. That portion of frame 34 interconnecting bottle receivers 36 serves as a convenient handle by which a user can pick up the bottles supported in carrier 32. The top surface of frame 34 is substantially flat although a plurality of optional longitudinal ribs 38 can be provided on the underside of the frame for purposes of reinforcement. As illustrated, reinforcing ribs 38 are provided along opposite sides of that portion of frame 34 interconnecting bottle receivers 36, with an intermediate pair of reinforcing ribs being disposed therebetween.

In contrast to the bottle receivers 14 of carrier 10 described above, each bottle receiver 36 of carrier 32 defines a generally circular opening 40 for releasably receiving and retaining a bottle. The opening 40 of each receiver 36 is bounded by a plurality of contiguous hollow cylindrical segments 42 of uniform sizes which are arranged in a circle rather than in the shape of a keyhole. Although segments 32 are illustrated as cylindrical, it will be understood that ovals, polygons and other hollow shapes can be employed to define the openings 40.

Cylindrical segments 42 of each receiver 36 yield to allow insertion of a bottle and then return or attempt to return to their nondeformed shape thereby securing the neck of the bottle therein. When the bottle is pulled and thus rotated in a plane transverse to frame 34, cylindrical segments 42 on opposite sides of the neck of the bottle deform so that the bottle can be disconnected from carrier 32.

As is best seen in FIG. 8, carrier 32 is particularly configured for use with two liter bottles. A circular cutout 44 is provided in the underside of the inner portions of cylindrical segments 42 for the purpose of receiving the collar which is typically found on such bottles in order to center and to help stabilize the bottles. It will be understood, however, that provision of cutouts 44 in receivers 36 is entirely optional.

Figure 9:
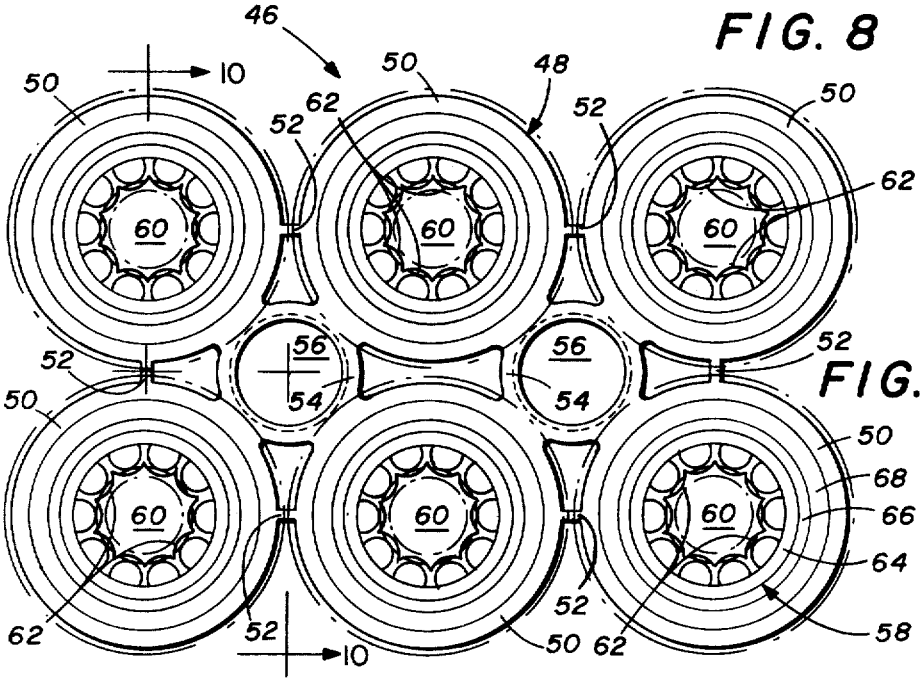
FIG. 9 is a top view of a bottle carrier incorporating a third embodiment of the invention.
Figure 10:
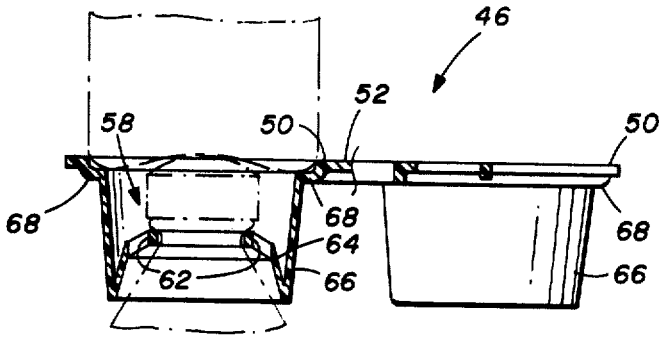
FIG. 10 is an enlarged sectional view taken along lines 10—10 of FIG. 9 in the direction of the arrows, with stacked bottles therein shown in phantom lines.

FIGS. 9 and 10 illustrate a bottle carrier 46 representing a third embodiment of the invention. Carrier 46, which is shown in a six-pack configuration, is also adapted to carry a plurality of bottles releasably united as a single package. The bottles have been shown in phantom lines. Carrier 46 is also suited for injection molding with plastic or other suitable material. The significance of this embodiment, however, involves the fact that bottle carrier 46 is especially configured to facilitate stacking with bottles in other carriers or in flat bottom cases. In addition, bottle carriers 46 are designed to nest together when empty to reduce space and thereby facilitate shipment thereof.

Bottle carrier 46 comprises a frame 48 having a substantially flat uppermost surface. In particular, frame 48 includes six circular portions 50 arranged in three pairs, each adjacent pair of which is interconnected by integral bridges 52 and webs 54. Finger holes 56 are provided in webs 54. It will thus be appreciated that the top surface of frame 48 is substantially flat so that filled bottle carrier 46 can be stacked with flat bottom cases.

A bottle receiver 58 is integrally formed into each circular portion 50 of carrier frame 48. Each bottle receiver 58 defines a generally circular opening 60 for releasably receiving and retaining a bottle by its neck. Each opening 60 is bounded by a plurality of contiguous hollow semicylindrical segments 62 arranged in a circle. The bottle receiving openings 60 of carrier 46 are thus generally circular like openings 40 of carrier 32, but are formed of hollow semicylindrical sections.

As is best seen in FIG. 10, the semicylindrical segments 62 surrounding each opening 60 are supported at the upper end by a recessed inner cup 64 which is joined to an outer cup 66 united to the corresponding circular portion 50.

The inner and outer cups 64 and 66 of each bottle receiver 58 are dimensioned to support the bottle such that its cap does not protrude above the flat top surface of frame 48. The upper end of each outer cup 66 is joined to its corresponding circular frame segment 50 by means of a recessed flange 68 dimensioned to receive the heel or bottom of a bottle stacked thereon. The lower ends of inner cups 64 and 66 converge and unite to contact the shoulders of the bottles secured in carrier 46 such that the weight of any cases or carriers of bottles stacked thereon is distributed into the lower bottles rather than only through the caps of the bottles. It will thus be appreciated that the configuration of carrier 46 provides greater stability when stacking cases or carriers of bottles. In all other respects, carrier 46 functions as hereinbefore described in connection with the previous carrier embodiments.

Figure 11:
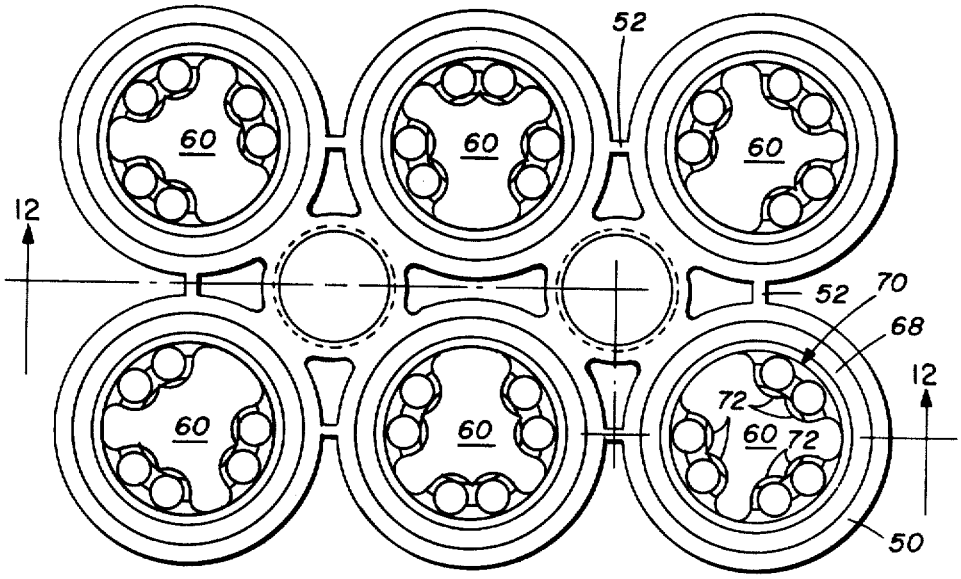
FIG. 11 is an illustration of a modification of the third embodiment.
Figure 12:
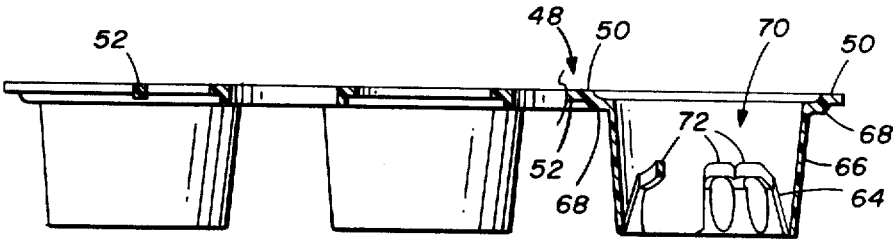
FIG. 12 is a sectional view taken along lines 12—12 of FIG. 11 in the direction of the arrows.

FIGS. 11 and 12 illustrate an alternate configuration which can be employed for the bottle receivers 58 of carrier 46. In some applications, it may not be necessary or desirable to define the bottle receiving openings 60 with hollow cylindrical segments extending completely therearound. That is, it may not always be necessary to engage the necks of the bottles at uniformly spaced points all around the necks. Bottle receiver 70 illustrates one approach to such a situation. The bottle receiving opening 60 is circumscribed by a plurality of hollow cylindrical segments 72 which are arranged in spaced apart groups, i.e., pairs in this case. The hollow cylindrical segments 72 are thus arranged to define an irregularly shaped opening bounded partially by three separate gaps, one of which is relatively wider than the other two gaps to facilitate insertion and disconnection of the bottles. Utilization of the modified bottle receiver 70 would thus result in material savings when molding bottle carrier 46.

Various configurations of particular bottle receivers have been illustrated and described herein with reference to particular frames; however, it will be understood that any of the receiver configurations can be incorporated into any of the other frames shown. For example, the bottle receiver of carrier 32 could be incorporated into carrier 10 and vice versa. The common feature underlying the various receiver configurations comprises the use of deformable hollow segments arranged to define an opening for releasably receiving the neck of a bottle.

From the foregoing, it will be apparent that the present invention comprises an improved bottle carrier having several advantages over the prior art. The bottle carrier herein can be fabricated as an integral unit, and employs unique bottle receiving structure adapted to positively retain the bottles with greater reliablity. Other advantages will suggest themselves to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications and rearrangements of elements falling within the scope of the invention as defined by the following claims.

I claim:

1. Apparatus for carrying a plurality of bottles, which comprises:

a generally flat frame having top and bottom surfaces;

said frame including a plurality of openings therein arranged in at least one spaced apart pair;

a pair of inner and outer cups associated with each opening in said frame, said cups each having upper and lower ends and being interconnected at the lower ends, the upper end of each outer cup being smaller in diameter than the corresponding frame opening and including a recessed annular flange peripherally connecting the upper end of said outer cup and the bottom surface of said frame, said flange being adapted to receive the heel of a bottle stacked upon said apparatus; and the upper end of each inner cup comprising a predetermined bottle receiving opening defined by hollow sections circularly arranged and adapted to receive and retain a bottle by its neck.

2. The apparatus of claim 1, wherein said frame further includes a pair of finger openings to facilitate handling of the apparatus.

3. The apparatus of claim 1, wherein the hollow sections are substantially cylindrical and are arranged in interconnected adjacent relationship to define a generally circular opening.

4. The apparatus of claim 1, wherein the hollow sections are substantially semicylindrical and are arranged in interconnected adjacent relationship to define a generally circular opening.

5. The apparatus of claim 1, wherein the hollow sections are generally circularly arranged in circumferentially spaced apart groups about each of the bottle receiving openings in said frame.

* * * * *